US007000914B2

(12) United States Patent
Guddanti et al.

(10) Patent No.: US 7,000,914 B2
(45) Date of Patent: Feb. 21, 2006

(54) IMAGING METHODS AND APPARATUS

(75) Inventors: Srinivas Guddanti, Boise, ID (US); Chet Butikofer, Meridian, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 296 days.

(21) Appl. No.: 10/122,439

(22) Filed: Apr. 13, 2002

(65) Prior Publication Data

US 2003/0194254 A1 Oct. 16, 2003

(51) Int. Cl.
*B65H 5/22* (2006.01)

(52) U.S. Cl. ..... 271/3.14; 271/4.01; 271/10.01; 271/163

(58) Field of Classification Search ..... 271/3.14, 271/4.01, 10.01, 163; 347/104; 399/369; 400/625

See application file for complete search history.

(56) References Cited

U.S. PATENT DOCUMENTS

| | | | | |
|---|---|---|---|---|
| 3,755,653 | A * | 8/1973 | Venker | 235/480 |
| 4,248,415 | A * | 2/1981 | Steinhilber | 271/9.02 |
| 4,688,957 | A * | 8/1987 | Prevignano | 400/605 |
| 4,854,757 | A * | 8/1989 | Kikuchi | 400/605 |
| 5,711,517 | A * | 1/1998 | Kelly | 271/4.01 |
| 5,897,110 | A * | 4/1999 | Fujiwara | 271/4.01 |
| 5,986,776 | A | 11/1999 | Park | 358/498 |
| 6,106,178 | A | 8/2000 | Chiu | 400/624 |
| 6,254,078 | B1 * | 7/2001 | Taruki | 271/3.01 |

* cited by examiner

*Primary Examiner*—David H. Bollinger

(57) ABSTRACT

Imaging apparatus and methods include providing an input support surface to support input imaging media and an output support surface to support output imaging media. The input support surface is configured to move relative to the output support surface, wherein such movement is in response to the drawing, or picking, of input imaging media from the input support surface, and wherein such movement is also proportional to the quantity of input imaging media picked from the input support surface.

21 Claims, 2 Drawing Sheets

IMAGING METHODS AND APPARATUS

FIELD OF THE INVENTION

The invention claimed and disclosed herein pertains to imaging media support, and more specifically, to methods and apparatus for supporting imaging media in conjunction with the operation of imaging devices.

BACKGROUND OF THE INVENTION

Various configurations of imaging apparatus and methods are known in the art. Imaging apparatus are configured to produce an image on an imaging media. Imaging apparatus are known by such names as printers, photocopiers, facsimile machines, and the like. Imaging apparatus and methods employ one of many known imaging processes to produce images, including those processes known as laser printing, inkjet printing, bubble jet printing, and the like. Imaging media can be in many forms, but it is generally in sheet form. Imaging media typically comprises paper, although other materials such as transparent plastic and the like are also utilized.

Prior art imaging apparatus typically comprise various subsystems. Such subsystems typically include an imaging section for producing the images as well as a media-handling system for moving the imaging media through the imaging apparatus. The imaging section comprises various known components that are configured to produce an image and to affix the image to the media. Likewise, the media-handling section comprises various known components that are configured to move the imaging media through the imaging section. Various other subsystems can be included in prior art imaging apparatus as well, such as duplexing devices, collating devices, and the like.

Generally, prior art imaging apparatus also include both input media trays and output media trays. The input imaging media trays are typically configured to hold a stack of input imaging media sheets in an input tray. The term "input imaging media" means imaging media to which images have not yet been affixed by the imaging apparatus. Accordingly, "input imaging media" can include imaging media that has been preprinted with a letterhead or the like. The term "stack" means a plurality of imaging media sheets that are adjacent to one another.

The output imaging media tray is generally employed to hold a stack of output imaging media. The term "output imaging media" means imaging media that has passed through the imaging section. Generally, output imaging media is imaging media to which the imaging apparatus has affixed an image. However, in some cases, media can pass through the imaging section without having an image deposited thereon.

Typically, prior art input and output trays are separate components with respect to one another, and are often located in different respective positions on the imaging apparatus, although in some case, the input and output media trays are located adjacent to one another. That is, generally, prior art imaging apparatus comprise input trays and output trays that are separate from one another.

A stack of input imaging media is generally manually loaded into the input media tray from which individual sheets are automatically drawn, or picked, and fed to the imaging section. As the input imaging media passes through the imaging section, an image is deposited on the input imaging media and affixed thereto, whereupon the input imaging media is converted to output imaging media. The output imaging media then exits the imaging section, and is deposited into the output media tray from which it is retrieved by a user of the imaging apparatus.

Although the prior art imaging apparatus configurations are known to function in a satisfactory manner, several disadvantages can be associated with the prior art input tray and output tray configurations. For example, a substantial portion of the size of a typical prior art imaging apparatus can be attributed to the inclusion of a separate input tray and output tray in prior art imaging apparatus along with the respective space associated with each for accumulated input and output imaging media. Also, an increased design and manufacturing cost can be associated with the prior art configuration of having two separate input and output trays which are often located at different areas of the respective imaging apparatus.

What is needed then are apparatus and methods which achieve the benefits to be derived from similar prior art apparatus and/or methods, but which avoid the shortcomings and detriments individually associated therewith.

SUMMARY OF THE INVENTION

An embodiment according to the present invention provides for a bi-functional imaging media input/output tray, as well as an imaging apparatus that incorporates such a bi-functional input/output tray. The bifunctional input/output tray according to the present invention includes an input support surface on which input imaging media can be supported, as well as an output support surface on which output imaging media can be supported. The input support surface is configured to move relative to the output support surface as a function of the quantity of input imaging media which is picked by the imaging apparatus from the input support surface. That is, as the input imaging media is used by the imaging apparatus, the input support surface moves away from the output support surface so as to effectively increase the space allocated for the output imaging media while simultaneously decreasing the space allocated for the input imaging media.

Another embodiment according to the present invention also provides for a method of feeding imaging media into an imaging apparatus, wherein the imaging media is supported and picked from an input support surface, and then deposited on an output support surface. The input support surface is moved away from the output support surface in response to picking the imaging media from the input support surface.

These and other aspects and embodiments of the present invention will now be described in detail with reference to the accompanying drawings, wherein:

DETAILED DESCRIPTION OF THE INVENTION

Apparatus and methods in accordance with an embodiment of the instant invention provide for efficient use of materials and space in conjunction with the support of imaging media in an imaging apparatus. In accordance with one embodiment of the present invention, an imaging apparatus includes a bi-functional imaging media input/output tray that is configured to simultaneously support thereon both a stack of input imaging media and a stack of output imaging media.

Such an input/output tray makes efficient use of space by providing an input support surface on which the input imaging media is supported and an output support surface on which the output imaging media is supported, wherein the input support surface is continually repositioned relative to the output support surface as a function of the relative proportions of input imaging media and output imaging media supported on the input/output tray.

In accordance with another embodiment of the present invention, an imaging apparatus includes a bi-functional imaging media input/output tray that comprises an input support surface, an output support surface, and an actuating mechanism. The input support surface is configured to support a stack of input imaging media, while the output support surface is configured to support a stack of output imaging media. The actuating mechanism is configured to move the input surface relative to the output surface. The input support surface is preferably moved away from the output support surface as the input imaging media is picked from the input support surface in order to define space between the input support surface and the output support surface for the output imaging media.

In accordance with yet another embodiment of the present invention, a media tray, which is for use with an imaging apparatus, is configured as a bi-functional imaging media input/output tray. The bi-functional imaging media input/output tray can include an input support surface configured to support a stack of input imaging media, and an output support surface configured to support a stack of output imaging media. The bi-functional imaging media input/output tray can also include an actuating mechanism that is configured to move the input support surface relative to the output support surface.

In accordance with still another embodiment of the present invention, a method of feeding imaging media into an imaging apparatus comprises providing both an input support surface as well as an output support surface, and supporting a stack of imaging media on the input surface. The method also includes picking the imaging media from the input support surface, and depositing the imaging media onto the output support surface. The method further includes moving the input support surface away from the output support surface in response to picking the imaging media from the input support surface.

Figure 1:
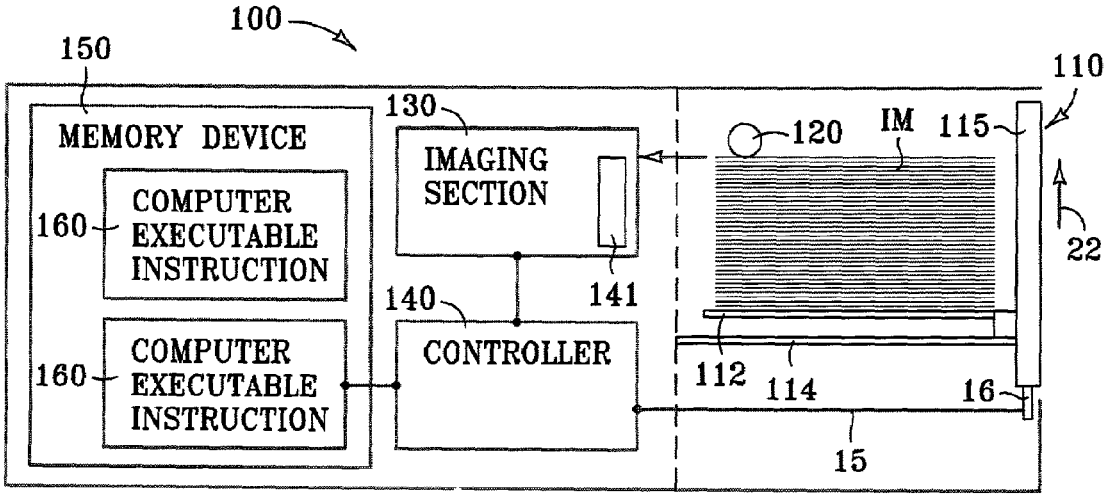
FIG. 1 is a side schematic view that depicts an apparatus in accordance with an embodiment of the present invention.

Turning now to FIG. 1, a side view schematic diagram is shown in which an imaging apparatus 100 in accordance with one embodiment of the present invention is depicted. The imaging apparatus 100 comprises a bi-functional imaging media input/output tray 110. The term "bi-functional imaging media input/output tray" as used herein means an imaging media tray that is configured to function simultaneously both as in input media tray and as an output media tray.

That is, the bi-functional input/output tray 110 is configured to simultaneously support both input imaging media and output imaging media. The imaging media input/output tray 110 preferably comprises both an input support surface 112 and an output support surface 114. The media input/output tray 110 also preferably comprises an actuating mechanism 115 which will be described more fully in later discussion.

The input support surface 112 is configured to support thereon a stack of input imaging media IM. The output support surface 114 is configured to support thereon a stack of output imaging media OM. The input imaging media IM and the output imaging media OM can be supported simultaneously on the input support surface 112 and the output support surface 114, respectively.

Preferably, both the input support surface 112 and the output support surface 114 are each configured to respectively support the input imaging media IM and the output imaging media OM in a substantially flat position and a substantially level orientation as shown. However, it is understood that the input support surface 112 and output support surface 114 can be alternatively configured, wherein the input imaging media IM and the output imaging media OM are respectively supported in respective alternative positions and orientations which are not specifically shown or described herein.

For example, the input support surface 112 and the output support surface 114 can be alternatively configured in manners wherein the imaging media IM and the output imaging media OM are respectively supported thereon in oblique orientations relative to one another. As a further example, the input support surface 112 and the output support surface 114 can be alternatively configured in manners wherein the input imaging media IM and the output imaging media OM are respectively supported thereon in parallel orientations relative to one another and are also inclined relative to the surface of the earth (not shown).

The imaging apparatus 100 also preferably comprises both a pick roller 120 and an imaging section 130. Pick rollers such as the pick roller 120 are known in the art and are generally included in prior art imaging apparatus to facilitate automatic handling of the input imaging media IM. The pick roller 120 is preferably configured to selectively pick sheets of input imaging media IM, one-at-a-time, from the top of the stack of input imaging media that is supported on the input support surface 112. Imaging sections such as the imaging section 130 are also known in the art and can have one of many possible configurations. The imaging section 130 is configured to produce an image (not shown) and affix the image to the input imaging media IM so as to form an output media OM.

More specifically, the pick roller 120 is configured to pick the input imaging media IM, one-at-a-time, from the stack of input imaging media supported on the input support surface 112, whereupon the sheets of input imaging media IM are then fed into the imaging section 130, one-at-a-time. As the sheets of input imaging media IM pass through the imaging section 130, respective images (not shown) are produced by the imaging section and are deposited on, and affixed to, the sheets of input imaging media.

When a given sheet of input imaging media IM has had an image affixed thereto by the imaging section 130, then the given sheet of input imaging media becomes output imaging media OM in accordance with the definition thereof as explained above. That is, as the input imaging media IM moves through the imaging section 130, it is converted into output imaging media OM by way of affixation thereto of respective images by the imaging section 130.

When the output imaging media OM exits the imaging section 130, it comes to rest on, and is supported by, the output support surface 114 of the input/output tray 110. An operator, or user, of the imaging apparatus 100 can then manually remove the completed output imaging media OM from the output support surface 114 of the input/output tray 110 through an opening or passageway (not shown) defined in the body of the imaging apparatus. Alternatively the imaging apparatus 100 can be configured so that the sides of the input/output media tray 110 are exposed so as to facilitate accessibility thereto.

As is further seen from an examination of FIG. 1, the imaging apparatus 100 also comprises a controller 140 which is configured to control various aspects of the imaging apparatus, such as the actuation of the actuating mechanism 115 for example, as will be described in later discussion. Also, the imaging apparatus 100 preferably includes a computer-readable memory device 150 ("memory device"). The controllers, such as the controller 140, and memory devices, such as the memory device 150, are known in the art and are generally included in prior art imaging apparatus.

The memory device 150 is preferably configured to be operatively accessible by the controller 140. That is, the memory device 150 is preferably configured to be linked in signal communication with the controller 140 so that the controller can access various data that can be stored in the memory device.

For example, one type of data that can be stored in the memory device 150 is a set of computer executable instructions 160. Preferably, the computer executable instructions 160 are accessible and executable by the controller 140. Thus, the imaging apparatus 100 preferably comprises a set of computer executable instructions 160 that are stored in the memory device 150 and that can be selectively accessed and executed by the controller 140 in conjunction with the operation of the imaging apparatus. The computer executable instructions 160 will be described in greater detail in later discussion.

Figure 2:
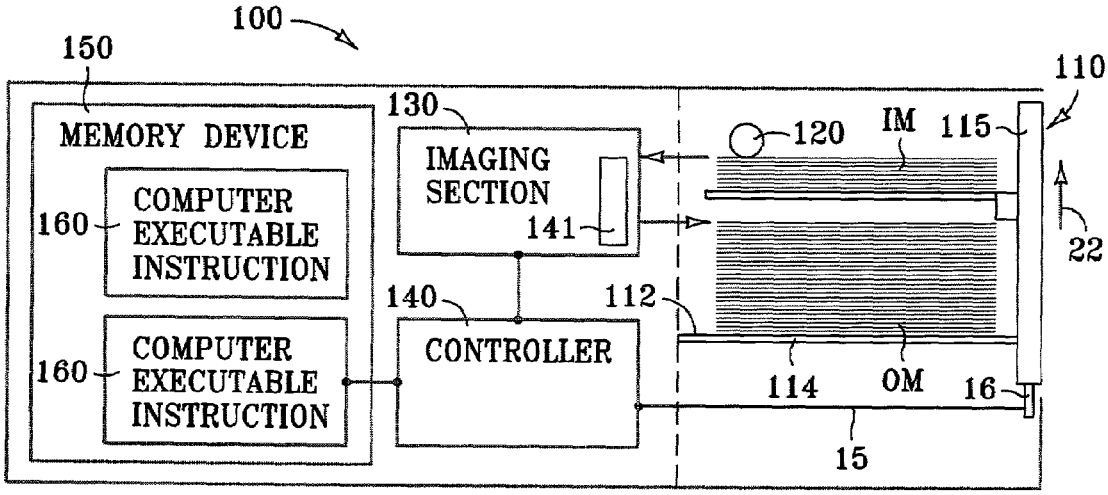
FIG. 2 is another side schematic view of the apparatus depicted in FIG. 1, wherein the input support surface is shown in a different position relative to the output support surface.

Moving now to FIG. 2, another side elevation schematic diagram is shown in which the imaging apparatus 100 is depicted. As is seen, FIG. 2 differs from FIG. 1 in that only input imaging media IM is shown supported on the input/output tray 110, and in that the input support surface 112 is shown in a different position relative to the output support surface 114. Thus as is seen, the input support surface 112 and the output support surface 114 are configured to move relative to one another. Such movement of the input support surface 112 and the output support surface 114 relative to one another can be accomplished by way of the actuating mechanism 115 as will be described in later discussion.

Preferably, the input/output tray 110 is configured so that, initially, when only input imaging media IM is supported on the input/output tray, the input support surface 112 and the output support surface 114 are substantially proximate one another as shown. The input support surface 112 is also preferably configured to move away from the input support surface 114, such as in the direction 22, as the input imaging media IM is picked from the stack of input imaging media supported on the input support surface. Such movement of the input support surface 112 relative to the output support surface 114 is preferable because it facilitates maximum efficiency in the utilization of space devoted to the input imaging media IM and to the output imaging media (shown in FIG. 1), as will become more apparent in later discussion.

The input support surface 112 is preferably configured to move relative to the output support surface 114, wherein such movement of the input support surface is in response to, and is directly proportional to, the quantity of input imaging media IM picked from the input/output tray 110. That is, preferably, as the input imaging media IM is picked from the top of the stack of input imaging media supported on the input support surface 112, the input support surface moves generally in the direction 22, and in proportion to the number of sheets of input imaging media IM picked from the input support surface.

For example, after a given number of sheets of input imaging media IM are picked from the stack of input imaging media supported on the input support surface 112, the input support surface will have moved a given distance relative to the output support surface 114 in the direction 22. Further, after twice the given number of sheets of input imaging media IM are picked from the stack of input imaging media supported on the input support surface 112, the input support surface will have moved substantially twice the given distance relative to the output support surface 114 in the direction 22.

Now with reference to both FIGS. 1 and 2, it is seen that the movement of the input support surface 112 relative to the output support surface 114 in response to the picking of the input imaging media IM from the stack of input imaging media supported on the input support surface results in generation of space for the output imaging media OM as it exits the imaging section 130 and accumulates on the output support surface. Conversely, as the input support surface 112 moves in the direction 22 relative to the output support surface 114, space for the input imaging media decreases. Thus, the input/output tray 110 is configured to facilitate maximum efficiency in the use of a given amount of space available for supporting both input imaging media IM and output imaging media OM.

That is, as the input imaging media IM is picked and fed into the imaging section 130, the quantity of input imaging media supported on the input support surface decreases, and thus, space allocated for the input imaging media correspondingly decreases as the input support surface moves in the direction 22 relative to the output support surface 114.

Conversely, as the imaging section 130 produces images, the quantity of output imaging media OM supported on the output support surface 114 increases, and thus, space allocated for the output imaging media correspondingly increases as the input support surface 112 moves in the direction 22 relative to the output support surface. In other words, as imaging media IM and OM is shifted from the input support surface 112 to the output support surface 114 during the production of images by the imaging section 130, the space allocated for the imaging media is correspondingly shifted from an area above the input support surface to an area below the input support surface.

As is further seen from a study of FIGS. 1 and 2, the input support surface 112 is preferably located above, and in substantially juxtaposed relation to, the output support surface 114. Additionally, the input support surface 112 and the output support surface 114 are preferably configured to remain substantially parallel to one another during movement of the input support surface 112 relative to the output support surface 114. However, it is understood that the imaging apparatus 100 can be alternatively configured in accordance with the present invention, wherein the input support surface 112 and the output support surface do not remain parallel to one another.

Moreover, the input support surface 112 and the output support surface 114 are preferably configured to support the input imaging media IM and the output imaging media OM, respectively, in substantially parallel orientation relative to one another. That is, the input support surface 112 and the output support surface 114 are preferably configured to respectively support the input imaging media IM and the output imaging media OM in manners wherein the sheets of input imaging media are substantially parallel to the sheets of output imaging media.

As mentioned above, the imaging apparatus 100 preferably includes an actuating mechanism 115 that is configured to move the input support surface 112 relative to the output support surface 114. That is, preferably, the input support surface 112 is supported on the actuating mechanism 115 so as to be moveable thereby relative to the output support surface 114. This can be accomplished in one of several manners by way of alternative configurations of the actuating mechanism 115.

For example, the actuating mechanism 115 can be configured, in one manner, as a biasing member, such as a spring or the like. In this manner, the actuating mechanism 115 is configured to bias the input support surface 112 away from the output support surface 114. That is, when configured as a biasing member, the actuating mechanism 115 is configured to resiliently deflect so as to store potential mechanical energy therein when the input support surface 112 and the output support surface 114 are moved toward one another. In other words, the actuating mechanism 115, when configured as a biasing member, is configured to bias the input support surface 112 away from the output support surface 114.

Figure 3:
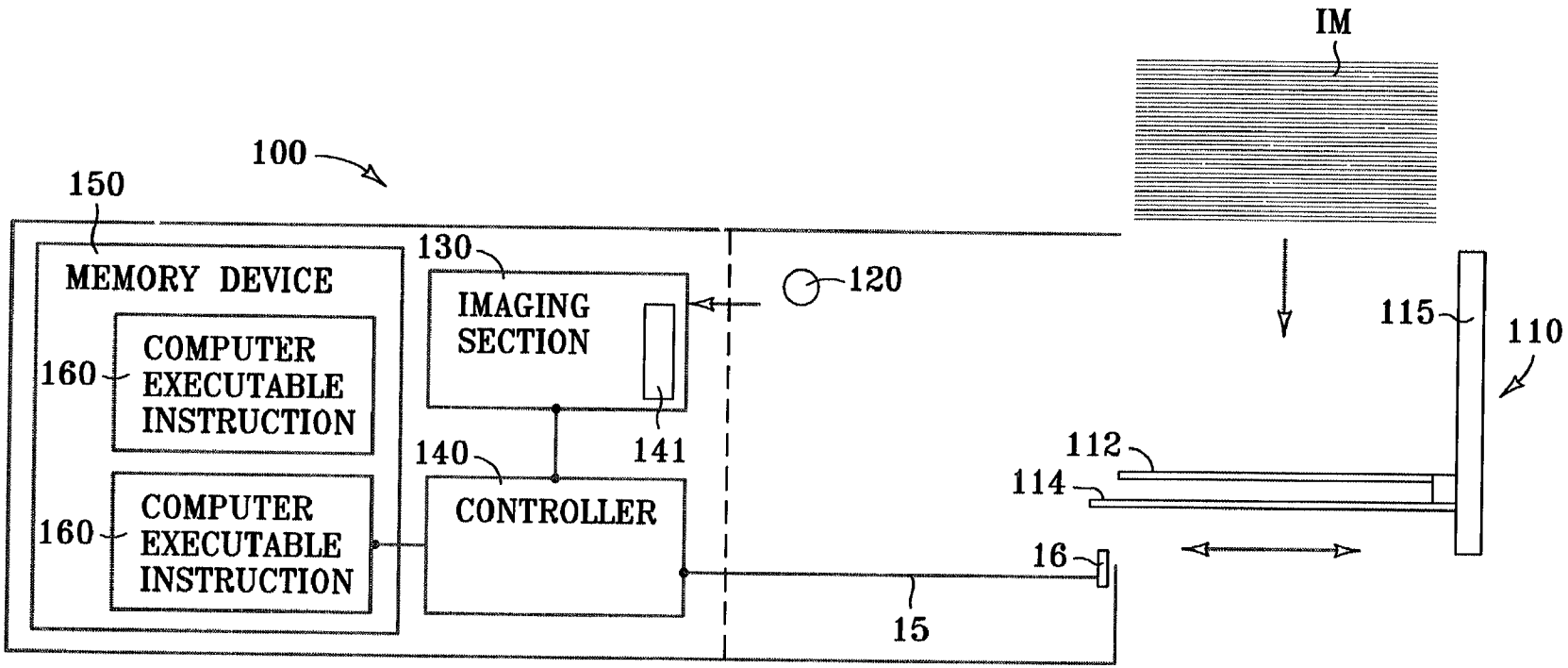
FIG. 3 is yet another side schematic view of the apparatus depicted in FIG. 1, wherein the input/output tray is shown in the open position.

Moving now to FIG. 3, yet another schematic diagram is shown in which the imaging apparatus 100 is depicted. As is seen, the input/output tray 110 can be configured to open and close relative to the imaging apparatus 100. That is, the term "open" means that the input/output tray 110 is positioned relative to the imaging apparatus 100 so as to facilitate loading of input imaging media IM onto the input support surface. Likewise, the term "closed" means that the input/output tray 110 is positioned relative to the imaging apparatus 100 so as to facilitate picking of the input imaging media IM from the input support surface 112.

The input/output tray 110 can employ any of a number of possible configurations to facilitate the opening and closing thereof. For example, the input/output tray 110 can be configured in the manner of a drawer or the like that can be opened by sliding out from the imaging apparatus 100 as shown. Likewise, the input/output tray 110 can be closed by sliding it into the imaging apparatus 100 in a drawer-like manner. The input/output tray 110 can thus be opened and closed in such a manner in order to facilitate loading of the input imaging media IM into the input/output tray 110, and to facilitate unloading of the output imaging media (shown in FIG. 1) from the input/output tray.

Still referring to FIG. 3, in the case wherein the actuating mechanism 115 is configured in the manner of a biasing member, such as a spring or the like as described above, the input/output tray 110 can be opened as shown, wherein an operator manually depresses the input support surface 112 toward the output support surface, and wherein the actuating mechanism is correspondingly resiliently deflected. The imaging apparatus 100 can comprise a catch (not shown) or the like, wherein, when the input support surface 112 is fully depressed, the catch engages and holds the input support surface in the fully depressed position against the biasing action of the actuating mechanism 115.

Once the input support surface 112 is fully depressed and the catch is engaged, the input imaging media IM can then be loaded into the input/output tray 110 by placing, for example, a stack of the input imaging media onto the input support surface 112. The input/output tray 110 can then be closed by sliding it fully into the imaging apparatus 100 as depicted in FIG. 2. Referring now to FIG. 2, the catch is preferably configured to automatically disengage and release the input support surface upon closure of the input/output tray 110, whereupon the actuating member 115 biases the input support surface 112 in the direction 22 so as to bias the top of the stack of input imaging media IM against the pick roller 120.

As the input imaging media IM is picked from the top of the stack of input imaging media supported on the input support surface 112, the actuating member moves the input support surface toward the pick roller 120 in the direction 22. Thus, the action of the actuating mechanism 115 serves to maintain contact between the input imaging media IM and the pick roller 120, and also serves to automatically generate space between the input support surface 112 and the output support surface 114, which space is utilized for accumulation of the output imaging media on the output support surface. Moreover, such a case wherein the actuating mechanism is configured as a biasing member, the actuating mechanism moves the input support surface 112 relative to the output support surface 114 in proportion to the quantity of input imaging media IM which is fed from the input support surface 112 into the imaging section 130.

In an alternative configuration, the actuating mechanism 115 can be configured as an actuator, such as a pneumatic cylinder, a hydraulic cylinder, a linear motor, or the like. In such a case wherein the actuating mechanism is configured as an actuator, the controller 140 is preferably configured to control the actuation of the actuating mechanism 115. More specifically, the controller 140 is preferably configured to be communicably linked with the actuating mechanism 115 so as to control the actuation thereof.

For example, the imaging apparatus 100 can include a communication link 15 such as an electrical wire, an optical fiber, or the like, that is configured to convey communication signals between the controller 140 and the actuator 115. Additionally, the imaging apparatus 100 can comprise a connector 16 that is configured to connect and disconnect the communication link 15 with respect to the actuator 115.

This can facilitate the opening of the input/output media tray 110 as is explained above with respect to FIG. 2. Alternatively, the connector 16 can be omitted from the imaging apparatus 100, in which case the communication link 15 can be configured, for example, as a helically coiled resilient cable (such as a telephone cord), or a cable on a spring-loaded reel, or the like.

In any case, the controller 140 is preferably configured to be linked in signal communication with the actuating mechanism 115 so as to control the actuation of the actuating mechanism in the manner described above. That is, the controller 140 is preferably configured to control the actuating mechanism 115 whereby the actuating mechanism causes the input support surface 112 to move relative to the output support surface 114, and wherein such movement of the input support surface is proportional to the quantity of input imaging media IM picked from the input support surface and fed into the imaging section 130.

The control of the actuating mechanism 115 by the controller 140 can be accomplished in accordance with one of several possible control schemes. In the case wherein the actuating mechanism 115 is configured as an actuator, the control of the actuating mechanism 115 is preferably accomplished by the controller 115 in conjunction with the utilization of the set of computer executable instructions 160. For example, the controller 140 is preferably configured to be communicably linked with the memory device 150, the imaging section 130, and the actuating mechanism 115 as shown so as to facilitate control of the actuating mechanism as discussed below.

For example, the set of computer executable instructions 160 can be configured so that, when executed by the controller 140, the actuation of the actuating mechanism is controlled in a manner wherein the actuating mechanism is caused to exert a force in the direction 22, and wherein such a force exerted by the actuating mechanism falls within a predetermined range of forces. In other words, the set of computer executable instructions 160 are preferably configured to facilitate control of the actuating mechanism 115 by the controller 140 so as to cause the actuating mechanism to urge the input support surface 112 in the direction 22, wherein the top of the stack of input imaging media IM which is supported on the input support surface is forced against the pick roller 120.

Preferably, such a force exerted by the actuating mechanism 115 in the direction 22 is caused to gradually decrease in response to the quantity of input imaging media IM which is fed into the imaging section 130. Such a decrease in the force exerted by the actuating mechanism is preferable in order to maintain a substantially constant force between the pick roller 120 and the top of the stack of input imaging media IM that is supported on the input support surface 112. That is, as the quantity of input imaging media IM that is supported on the input support surface 112 decreases, the amount of force required to overcome the weight of the input imaging media supported on the input support surface will correspondingly decrease.

In other words, when a given quantity of input imaging media IM is supported on the input support surface 112, a given portion of the force exerted by the actuating mechanism 115 in the direction 22 is required simply to overcome the gravitational force exerted on the input imaging media in the opposite direction. The remainder of the force exerted by the actuating mechanism 115 in the direction 22 results in a force between the top of the stack of input imaging media IM and the pick roller 120.

Thus, as the quantity of input imaging media IM supported on the input surface 112 decreases, a greater proportion of the force exerted by the actuating mechanism is directed toward pressing the input imaging media against the pick roller. Thus, the total force required from the actuating mechanism 115 decreases as the quantity of input imaging media IM supported on the input surface decreases.

This compensation for the decrease in the weight of the input imaging media IM can be accomplished by the controller 140 in conjunction with the set of computer executable instructions 160. For example, the imaging section 130 is preferably configured to generate and send signals to the controller 140, wherein such signals are received by the controller and indicate to the controller the quantity of input imaging media IM that is fed into the imaging section from the input support surface 112. For example, a signal can be generated by the imaging section 130 and sent to the controller 140 each time a sheet of input imaging media IM is fed into the imaging section 130 from the input support surface 112.

Specifically, such a signal can be generated, for example, by a paper feed sensor 141 which can be included in the imaging apparatus 100 and which is preferably located so that the passing of a sheet of input imaging media IM is detected. For example, the paper feed sensor 141 can be located in the imaging section 130. The feed sensor 141 can alternatively be configured to detect the passing of a sheet of output imaging media OM.

In either case, the paper feed sensor 141 is preferably configured to detect the drawing, or picking, of the input imaging media IM from the input support surface 112, and to generate a signal in response to detecting the drawing of the input imaging media. Further, the paper feed sensor 141 is preferably configured to transmit the signal to the controller 140, wherein actuation of the actuating mechanism is controlled in response to receiving the signal, as described below.

The controller 140 is preferably configured to receive such signals, and to process the signals in conjunction with the set of computer executable instructions 160 which are stored in the memory device 150 and which are accessed by the controller. More specifically, the computer executable instructions 160 are preferably in the form of a program that is configured to process the counting signals received from the imaging section 130 and to calculate the decrease in force exerted by the actuating mechanism 115 in order to compensate for the decrease in quantity of input imaging media IM supported on the input support surface 112.

Additionally, the imaging apparatus 100 can be configured to allow an operator of the apparatus to input into the memory device 150 the type of input imaging media IM that is supported on the input support surface 112. In other words, for example, the imaging apparatus 100 is preferably configured to allow an operator to tell the controller 140 what type of paper has been loaded into the imaging apparatus. The set of computer executable steps stored in the memory device 150 are also preferably configured to convert the type of paper, as input by the operator, into a weight per sheet. This can be accomplished, for example, by storing within the memory device 150 an average weight per sheet of a number of various known types of paper.

Thus, by telling the controller 140 what type of input imaging media IM has been loaded into the input/output tray 110, the controller, in conjunction with the computer executable instructions 160, can calculate an approximate weight per sheet of the input imaging media. In this manner, the controller 140 can more precisely reduce the force exerted by the actuating mechanism 115 in compensation for the decrease in the quantity of input imaging media IM as the input imaging media is fed into the imaging section 130 from the input support surface 112.

In the manner described above, the controller 140 can be configured to control the actuation of the actuating mechanism 115 in response to the quantity of input imaging media IM that is drawn, or picked, from the input support surface 112. That is, the controller 140 is preferably configured to control the actuation of the actuating mechanism 115 to move the input support surface 112 a predetermined distance in response to the picking of a predetermined number of sheets of input imaging media. The movement of the input support surface 112 can be in response to the controller 140 receiving the signal which is generated as described above in response to detecting the drawing of input imaging media IM from the input support surface.

The controller 140 can also be configured to detect when the input/output media tray 110 is opened. For example, the connector 16 can alternatively be configured as a sensor that detects when the input/output media tray 110 is open and when it is closed. In this manner, the actuating mechanism 115 can be configured to automatically cause the input support surface 112 to lower to a load position, wherein the input support surface moves to a position that is substantially proximate the output support surface 114 as shown in FIG. 2. This can facilitate loading of input imaging media IM into the imaging apparatus 100. Likewise, the controller 140 is preferably configured to cause the input support surface 112 to raise the stack of input imaging media IM into contact with the pick roller 120 when the controller detects that the input/output media tray 110 has been closed.

In accordance with another embodiment of the present invention, a media tray for use in an imaging apparatus comprises a bi-functional imaging media input/output tray 110. That is, in accordance with another embodiment of the present invention, a media tray can comprise the input/output tray 110 which has been described above and which is shown in the accompanying figures, wherein the media tray is intended to be used in an imaging apparatus such as the apparatus 100 which is described above an shown in the accompanying figures.

Referring to FIGS. 1, 2, and 3, the media tray 110 comprises an input support surface 112, an output support surface 114, and an actuating mechanism 115. The input support surface 112 is configured to support a stack of input imaging media IM, while the output support surface 114 is configured to support a stack of output imaging media OM. The actuating mechanism 115 is configured to move the input support surface 112 relative to the output support surface 114 as described above with respect to the apparatus 100.

Preferably, the input support surface 112 of the media tray 110 is supported on the actuating mechanism 115 so as to facilitate movement of the input support surface by the actuating mechanism. The input support surface 112 and the output support surface 114 are preferably maintained in substantially parallel, juxtaposed relation to one another. Further, the input support surface 112 is preferably located above the output surface 114.

In accordance with yet another embodiment of the present invention, a method of feeding imaging media into an imaging apparatus comprises providing an input support surface, such as the input support surface 112, which is configured to support the imaging media in sheet form. The method also comprises providing an output support surface such as the output support surface 114, which is located below the input support surface and which is configured to support the imaging media in sheet form.

The method further includes supporting a stack of imaging media on the input surface, and picking, or drawing, the imaging media from the input support surface, one-sheet-at-a-time. The imaging media is then deposited onto the output support surface, one-sheet-at-a-time. Additionally, the input support surface is moved away from the output support surface in response to picking the input media from the input surface. For example the input support surface can be moved relative to the output support surface in accordance with the process as is described above with respect to the input support surface 112 and the output support surface 114 which are shown in the accompanying figures.

In accordance with the method, the movement of the input support surface is preferably substantially proportional to the quantity of imaging media picked in order to generate a space below the input support surface for accumulation of the imaging media on the output support surface. That is, preferably, as the imaging media is picked, or drawn, from the input support surface, the input support surface moves away from the output support surface in order to generate space between the input support surface and the output support surface. Such space between the input support surface and output support surface is utilized for the accumulation of the imaging media on the output support surface.

In accordance with still another embodiment of the present invention, a method of feeding sheet media through an imaging apparatus comprises providing a bi-functional imaging media input/output tray having an input support surface and an output support surface below the input surface. For example, the bi-functional imaging media input/output tray can be configured in the manner of the input/output tray 110 which is described above with respect to the apparatus 100, and which is shown in the accompanying figures. Further, the input support surface and the output support surface can be respectively configured in the manners of the input support surface 112 and the output support surface 114 which are described above with respect to the apparatus 100, and which are shown in the accompanying figures.

The method also includes supporting a sheet of imaging media on the input surface and picking, or drawing, the sheet of imaging media from the input support surface. An image is generated on the sheet of imaging media and the sheet is deposited on the output surface.

While the above invention has been described in language more or less specific as to structural and methodical features, it is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. An imaging apparatus, comprising a bi-functional imaging media input/output tray which comprises:
- an output support surface;
- an input support surface that is located above, and in substantially parallel juxtaposed relation to, the output surface; and,
- an actuating mechanism configured to move the input surface in a substantially vertical direction while maintaining the substantially parallel, juxtaposed relation of the input surface and the output surface.

2. The imaging apparatus of claim 1, and wherein:
- the input/output tray is movable between an opened position and a closed position with respect to the imaging apparatus; and
- the input support surface is configured to lower to a load position, wherein the input support surface is proximate the output support surface, and wherein the input support surface is automatically lowered to the load position in response to moving the input/output tray to the opened position.

3. The imaging apparatus of claim 2, and wherein the input/output tray is substantially a drawer that is movable between a closed position and an opened position, and is configured to be placed into the opened position by sliding out from the imaging apparatus, and is further configured to be placed into the closed position by sliding into the imaging apparatus.

4. An imaging apparatus, comprising a bi-functional imaging media input/output tray which comprises:
- an output support surface;
- an input support surface that is located above, and in substantially parallel juxtaposed relation to, the output surface;
- an actuating mechanism configured to move the input surface in a substantially vertical direction while maintaining the substantially parallel juxtaposed relation of the input surface and the output surface; and, a picking mechanism configured to pick a quantity of input media from the input surface, wherein movement of the input support surface is in response to, and is substantially directly proportional to, the quantity of input imaging media picked from the input/output tray.

5. An imaging apparatus, comprising a bi-functional imaging media input/output tray which comprises:

an output surface;

an input surface located substantially above the output surface; and an actuating mechanism configured to move the input surface in a substantially vertical direction while maintaining a substantially parallel juxtaposed relation of the input surface relative to the output surface.

6. The imaging apparatus of claim 5, and wherein the input surface is supported on the actuating mechanism.

7. An imaging apparatus, comprising a bi-functional imaging media input/output tray which comprises:

an output surface;

an input surface;

an actuating mechanism configured to move the input surface in a substantially vertical direction while maintaining a substantially parallel juxtaposed relation of the input surface relative to the output surface; and, a controller that is configured to control the actuation of the actuating mechanism.

8. An imaging apparatus, comprising a bi-functional imaging media input/output tray which comprises:

an output surface;

an input surface;

an actuating mechanism configured to move the input surface relative to the output surface; and, a controller configured to control the actuation of the actuating mechanism in response to the quantity of input imaging media that is drawn from the input surface.

9. The imaging apparatus of claim 8, and wherein the actuating mechanism is further configured to maintain the input surface and the output surface in substantially parallel juxtaposed relation to one another.

10. The imaging apparatus of claim 9, and wherein the input surface is located above the output surface.

11. The imaging apparatus of claim 8, and further comprising a computer readable memory device in signal communication with the controller, the memory device containing a series of computer executable steps configured to cause the controller to actuate the actuating mechanism in response to the quantity of input imaging media picked from the input/output tray.

12. The imaging apparatus of claim 11, and further comprising a paper feed sensor in signal communication with the controller and configured to:

detect the drawing of input imaging media from the input surface;

generate a signal in response to detecting the drawing of input imaging media from the input surface; and, transmit the signal to the controller, wherein the actuation of the actuating mechanism is controlled in response to receiving the signal.

13. The imaging apparatus of claim 12, and wherein the controller is configured to actuate the actuating mechanism, whereby the input surface is moved a predetermined distance in response to receiving the signal.

14. A media tray for use with an imaging apparatus, the media tray comprising a bi-functional imaging media input/output tray which comprises:

an output surface;

an input surface;

an actuating mechanism configured to move the input surface in a substantially vertical direction while maintaining a substantially parallel juxtaposed relation of the input surface relative to the output surface; and, a controller that is configured to control the actuation of the actuating mechanism.

15. The media tray of claim 14, and wherein the input surface is supported on the actuating mechanism.

16. A media tray for use with an imaging apparatus, comprising:

an output surface;

an input surface, wherein the input surface is located above the output surface; and, an actuating mechanism configured to move the input surface in a substantially vertical direction while maintaining a substantially parallel juxtaposed relation of the input surface relative to the output surface.

17. A method of feeding imaging media into an imaging apparatus, comprising:

providing an input support surface;

providing an output support surface which is located below the input surface;

supporting a stack of imaging media on the input support surface;

picking the imaging media from the input support surface, one-sheet-at-a-time;

depositing the imaging media onto the output support surface, one-sheet-at-a-time; and, moving the input surface away from the output support surface in response to picking the input media from the input support surface.

18. The method of claim 17, and wherein the movement of the input support surface is substantially proportional to the quantity of imaging media picked to facilitate maintenance of a space below the input surface for deposition of the imaging media on the output surface.

19. A method of feeding a sheet of imaging media through an imaging apparatus, comprising:

providing a bi-functional input/output tray having an input support surface and an output support surface below the input support surface;

supporting the sheet of imaging media on the input support surface;

picking the sheet of imaging media from the input support surface;

moving the input surface substantially upwardly and away from the output surface;

generating an image on the sheet of imaging media; and, depositing the sheet of imaging media on the output support surface.

20. An imaging apparatus, comprising a bi-functional imaging media input/output tray, and wherein the media input/output tray comprises:

an input support surface configured to support thereon a stack of input imaging media; and, an output support surface configured to support thereon a stack of output imaging media, wherein:

the input support surface is located above and in substantially parallel juxtaposed relation to the output support surface;

the input/output tray is movable between an opened position and a closed position with respect to the imaging apparatus; and the input support surface is configured to be automatically lowered to a load position in response to moving the input/output tray to the opened position, in which load position the input support surface is proximate the output support surface.

21. The imaging apparatus of claim 20, and wherein the input/output tray is configured in the manner of a drawer that is movable between a closed position and an opened position, and is configured to be placed into the opened position by sliding out from the imaging apparatus, and is further configured to be placed into the closed position by sliding into the imaging apparatus.

* * * * *